US005249819A

United States Patent [19]

Mayr

[11] Patent Number: 5,249,819

[45] Date of Patent: Oct. 5, 1993

[54] SKI HAVING A HOLLOW BODY OF UNIFORM WIDTH

[75] Inventor: Bernhard Mayr, Hard, Austria

[73] Assignee: Head Sportgerate Gesellschaft m.b.H. & Co., OHG, Kennelbach, Austria

[21] Appl. No.: 803,693

[22] PCT Filed: Sep. 21, 1989

[86] PCT No.: PCT/AT89/00086

§ 371 Date: Jul. 19, 1990

§ 102(e) Date: Jul. 19, 1990

[87] PCT Pub. No.: WO90/03205

PCT Pub. Date: Apr. 5, 1990

Related U.S. Application Data

[63] Continuation of Ser. No. 474,795, Jul. 19, 1990, abandoned.

[30] Foreign Application Priority Data

Sep. 23, 1988 [AT] Austria ..... A 2362/88

[51] Int. Cl.[5] ..... A63C 5/04; A63C 5/14; A63C 5/07

[52] U.S. Cl. ..... 280/602; 280/607; 280/608; 280/609; 280/610

[58] Field of Search ..... 280/602, 607, 609, 610, 280/14.2, 28, 608, 615; 441/68, 74

[56] References Cited

U.S. PATENT DOCUMENTS

| | | | |
|---|---|---|---|
| 2,544,028 | 3/1951 | Kjellberg | 280/610 |
| 3,132,874 | 5/1964 | Baudou | 280/610 |
| 3,372,943 | 3/1968 | Grossauer | 280/610 |
| 3,414,279 | 12/1968 | Allain | 280/610 |
| 3,614,116 | 10/1971 | Haldemann | 280/610 |
| 3,628,802 | 12/1971 | Hashimoto et al. | 280/610 |
| 3,635,484 | 1/1972 | Nakamura et al. | 280/610 |
| 3,698,731 | 10/1972 | Jost et al. | 280/610 |
| 3,727,936 | 4/1973 | Klir et al. | 280/610 |
| 3,933,362 | 1/1976 | Sakuma et al. | 280/610 |
| 3,940,157 | 2/1976 | Sakuma | 280/610 |
| 4,077,652 | 3/1978 | McCaskey, Jr. et al. | 280/610 |
| 4,679,813 | 7/1987 | Girard | 280/602 |
| 5,005,853 | 4/1991 | Lampl | 280/610 |
| 5,064,214 | 11/1991 | Diard et al. | 280/609 x |

FOREIGN PATENT DOCUMENTS

| | | | |
|---|---|---|---|
| 3C9282 | 8/1973 | Austria . | |
| 734828 | 5/1966 | Canada | 280/610 |
| 787260 | 6/1968 | Canada | 280/610 |
| 917688 | 12/1972 | Canada | 280/610 |
| 0167462 | 1/1986 | European Pat. Off. | 280/607 |
| 278859 | 8/1988 | European Pat. Off. . | |
| 2332909 | 1/1974 | Fed. Rep. of Germany | 280/610 |
| 2406145 | 8/1974 | Fed. Rep. of Germany . | |
| 1098711 | 4/1955 | France | 280/607 |
| 1380663 | 10/1964 | France | 280/610 |
| 2565116 | 12/1985 | France . | |
| 59763 | 8/1938 | Norway | 280/610 |
| 8700763 | 2/1987 | World Int. Prop. O. | 280/602 |
| 8705525 | 9/1987 | World Int. Prop. O. . | |

*Primary Examiner*—Brian Johnson

*Attorney, Agent, or Firm*—Cushman, Darby & Cushman

[57] ABSTRACT

A ski with a base portion having a running surface of varying width and a hollow ski body. The height of the ski varies over the length of the ski. The ski body is hollow with lateral edges extending parallel to each other over the length of the ski. The width of the ski body is constant and is less than, or equal to, the narrowest width of the base portion.

7 Claims, 6 Drawing Sheets

SKI HAVING A HOLLOW BODY OF UNIFORM WIDTH

This is a continuation of application No. 07/474,795, filed on Jul. 19, 1990, which was abandoned upon the filing hereof.

BACKGROUND OF THE INVENTION

Field of the Invention

The invention relates to a ski with a running surface and a hollow ski body, the standard height, measure with respect to the running surface, varies over the length of the ski.

Description of the Related Art

A plastic ski is already known from Austrian Patent AT-PS 309 282, the upper chord and lower chord of which or its running surface component and the surface component facing away from the running surface, are connected with each other by means of longitudinally extending connectors laterally offset from each other. A hollow ski body is formed in this way, in which the height of the connector can be chosen by means of an appropriate shaping of the form in such a way that the result is a structural height of the entire ski which varies in the longitudinal direction of the ski. In connection with such known plastic skis it was required to use a separate mold for every type of ski and for each constriction of the ski in order to form the appropriate hollow spaces in the core of the ski after the individual components had been connected. Relatively unpredictable sturdiness and relatively large fluctuations of the torsional behavior of the ski body are the result of such shaping of the hollow body, with lateral surfaces of the core following the respective lateral contours of the ski. This is particularly true in connection with the forming of special skis with varied constriction.

SUMMARY OF THE INVENTION

It is an object of the invention to provide a ski of the previously mentioned type where it is possible to define more exactly the properties of sturdiness, flexibility and torsional behavior over the length of the ski and to make them as independent as possible of the constriction of the ski. To attain this object, the ski of the invention is provided with a ski body in the form of a hollow body with lateral edges which are parallel to each other and extend in the longitudinal direction of the ski. The width of the ski body is less than or equal to the narrowest width of the constricted running surface component, measured crosswise to the longitudinal direction of the ski. Based on the fact that a ski body of generally even width is formed as a hollow body, it is possible to predetermine a defined and high torsional stiffness by simply presetting the respective ratio of height to width. By means of such a component it is possible to determine, in particular, the most advantageous ratio of width to height, particularly in the end areas, namely the areas of the tip and the end of the ski. Selection of such a hollow body of even width as a ski body has as a result that, depending on the constriction of the ski, the running surface component extends differently beyond the sides of the ski body. The running surface component can be distinguished by relatively good lateral stiffness and in particular by even lateral stiffness. The fact that the running surface component laterally extends beyond the ski body results in particular in an improved grip on ice because of narrow lateral contact surfaces when the ski is tilted. For this reason it is necessary, as provided by the invention, that the width of the ski body be less than or equal to the narrowest width of the constricted running surface component, measured crosswise to the longitudinal direction of the ski.

The ski body, or hollow body, can be advantageously provided as a shell body and can be enclosed at the side facing away from the running surface component by an upper chord component. Considerable technical manufacturing advantages ensue even with the embodiment of such a hollow body in the form of a shell body. In this embodiment it is possible to retain the same width of the ski body over the entire length of the ski, because the upper chord need not extend beyond the lateral edges of the ski body in any way. With the embodiment of the hollow body as a shell body it is therefore possible to use a core of extruded profiles which are continuously produced and cut to the length of a ski, and the thickness profile can be milled on the upper and/or lower shell.

The embodiment of the invention is advantageously improved in that lateral surface parts, adapted to the outer contours of the running surface component, are connected to the lateral edges of the hollow body, the height of which corresponds to at least a portion of the height of the hollow body. Such lateral surface components, added for esthetic or design purposes to the lateral surfaces of the ski body, may in this case be made without a problem with a lesser height than the height of the hollow body and may have, for example, the same height across the entire length of the ski. In particular this has important advantages with regard to gripping on ice, because the lateral contact surface can be kept constant over the entire length of the ski when it is tilted, despite the varied thickness of the ski. An important advantage in this case is that the lateral components are not required in any way to add to the properties of stiffness and flexibility, because the torsional stiffness and the desired properties of the material have already been defined by the size and shape of the hollow ski body per se.

An additional technical simplification of manufacturing results when the embodiment has been made in such a way that the hollow body is divided in the longitudinal direction of the ski. With such embodiments a building block system for skis with varied lateral shapes can be used in a simple way. To ease the shaping of the hollow body as a hollow body without a longitudinal seam or as a tube-shaped hollow body, the embodiment is made advantageously in such a way that the lateral surfaces of the hollow body form an angle with the running surface plane other than 90°.

In principle the hollow body can be of single or multiple chamber construction, as already proposed for conventional skis. Fiber-reinforced thermoplastic or thermo-setting plastic can be used in a particularly advantageous way as a material for the torsion box. Division of the hollow body in the longitudinal direction of the ski makes it possible to account more accurately for the different demands made on the torsional properties in the longitudinal direction of the ski in different subareas of the ski and in particular offers the chance to prepare the center area for receiving binding parts in an appropriate manner. The embodiment is made advantageously in such a way that in the longitudinal direction the center part of the ski has a partial area of even height,-where ski binding parts and/or ski binding fastening parts may be integrated in the center part of the hollow body.

The chance of using extruded, continuously produced profiles in particular provides a possibility for producing the embodiment in this case in such a way, that the hollow body is comprised of a plurality of profiles or chambers extending in the longitudinal direction.

By means of such a hollow ski body it is furthermore possible to achieve a reduction in weight simultaneously with improved torsional stiffness and in particular it is possible to control and set the required torsional stiffness in the end areas of the ski more exactly.

The invention will be described in detail below by means of exemplary embodiment shown in the drawings.

DETAILED DESCRIPTION OF THE DRAWING FIGURES

Figure 1:
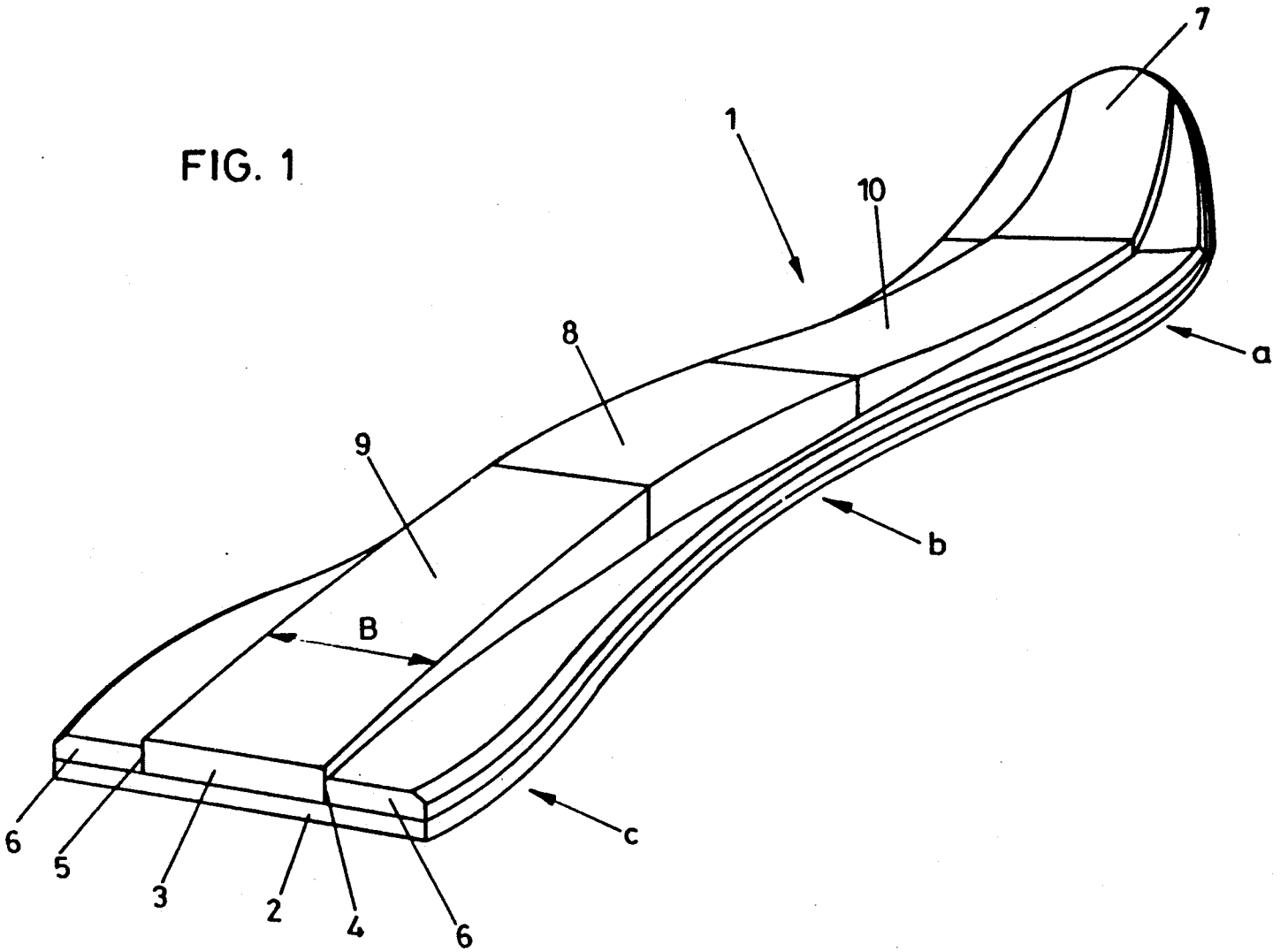
FIG. 1 is a perspective view of a ski in accordance invention.

In FIG. 1, a ski is indicated by 1, having a running surface component 2 and a hollow ski body 3 extending over the length of the ski, the standard height of which in respect to the running surface component 2 varies over the length of the ski, as will be shown in detail by means of the cross-sectional views of FIGS. 2 to 7 at the points indicated with a, b and c. The hollow ski body 3 has lateral edges or lateral cheeks 4 and 5 extending parallel to each other in the longitudinal direction of the ski over the entire length of the ski, the width B of the hollow body 3 being less than or equal to the narrowest width of the running surface component measured crosswise to the longitudinal direction of the ski. In a ski having a constriction, such as shown in FIG. 1, the running surface component extends out to a different degree under the hollow ski body 3 in different portions, as also shown in more detail in FIGS. 2 to 7. Lateral surface components 6, which are of various widths corresponding to the different width of the ski, and the height of which corresponds to at least a part of the height of the hollow body 3, are provided for suitable closing of the area where the running surface component 2 exceeds the width of the hollow ski body, various embodiments of such lateral surface components being shown in detail in FIG. 8. The tip of the ski has been designated by 7. The hollow body 3, designed with lateral edges 4, 5 of different height and extending parallel to each other in the longitudinal direction of the ski, can either be extend continuously over the entire length of the ski or, as indicated in FIG. 1, be divisible crosswise to the longitudinal direction of the ski in the central section, the center portion of the hollow ski body being of even height. By means of the division of the hollow ski body 3 into a center portion 8, an end portion 9 and a front portion 10, indicated in FIG. 1, it is more easily possible to take into account the torsional or stiffness properties of the ski. It is furthermore possible to integrate, in the center portion 8 of the hollow body, ski binding parts and/or ski binding fastening parts which, for the sake of clarity, have not been shown in FIG. 1.

Figure 2A:
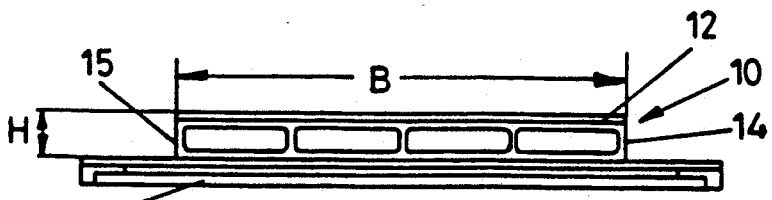
FIGS. 2 to 7 are cross sections of various embodiments of a ski of the invention in accordance with FIG. 1, FIGS. *2a* to *7a* being cross sections of the tip area. FIGS. *2b* to *7b* cross sections of the area of the bindings and FIGS. *2c* to *7c* cross sections in the end area of the ski.
Figure 2B:
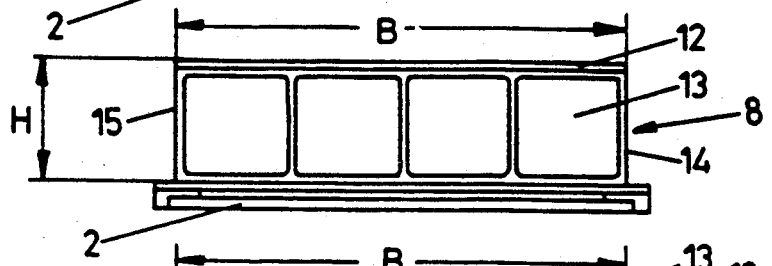
Figure 2C:
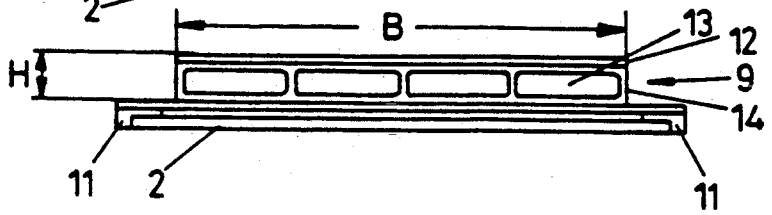
Figure 3A:
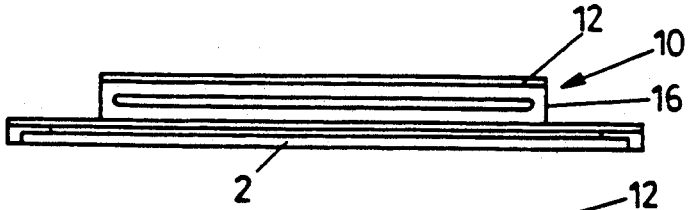
Figure 3B:
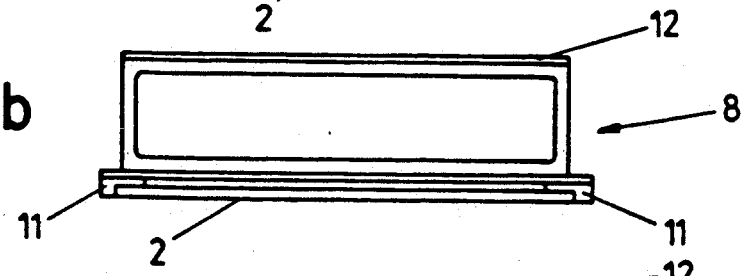
Figure 3C:
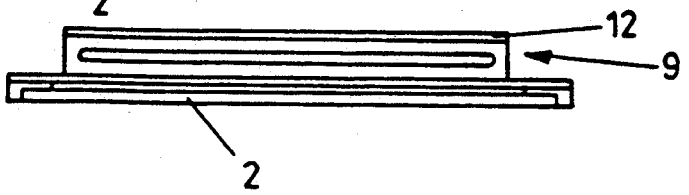

A cross section of the center portion 8, the end portion 9 and the front portion 10, respectively, of the hollow ski body 3 at the points indicated by a, b and c in FIG. 1 is shown in FIGS. 2 to 7. The running surface component 2 may be composed of one or a plurality of layers. As is customary, edges 11 are integrated into the lateral edges of the running surface component 2. As shown in each one of FIGS. 2 to 7, the width B of the ski body 3 in case is the same over the entire length of the ski and each time is less than or maximally the same as the narrowest width of the running surface component 2. Furthermore it can be seen that the standard height H of the ski body 3 on the running surface component 2 varies in different parts along the length of the ski, the hollow ski body having the greatest height in the center portion 8 and tapering towards the end and the tip areas. It is possible to provide on the hollow ski body a cover or a top chord 12, as shown in FIGS. 2 and 3. In FIGS. 2 to 7 lateral surface components, adjoining the hollow body 3 and adapted to the outer contours of the running surface component, are not shown, reference is made to FIG. 8 for showing the design of such lateral surface components.

In the embodiment of FIG. 2, the hollow body is composed of a hollow body structure 14 comprising four chambers 13, each one of the connectors 15 normally disposed on the running surface component 2 having different heights in different sectors in the longitudinal direction of the ski. In the embodiment in accordance with FIG. 3, a hollow body structure 16 with a single chamber is used. The hollow body structures in accordance with FIGS. 2 and 3 are in the shape of a seamless hose and are connected with the running surface component 2 in a conventional way by gluing or the like.

Figure 4A:
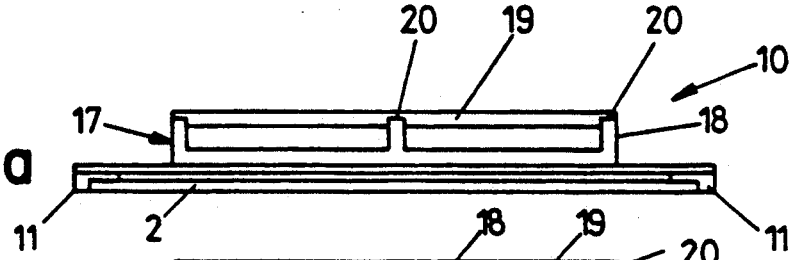
Figure 4B:
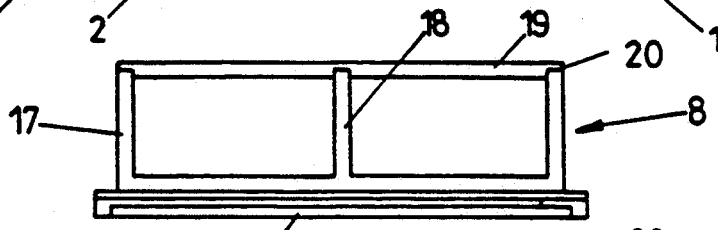
Figure 4C:
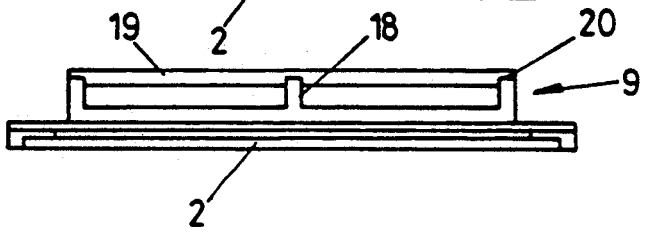

A two-chamber shell construction is used for the hollow body 3 in FIG. 4, the lower shell portion 17 being in the shape of a letter W the connectors 18 of which, extending normally on the running surface layer 2, having different heights. The upper shell part 19 is flat and has grooves 20 for positive gluing of the lower shell-part 17 with the upper shell part 19.

Figure 5A:
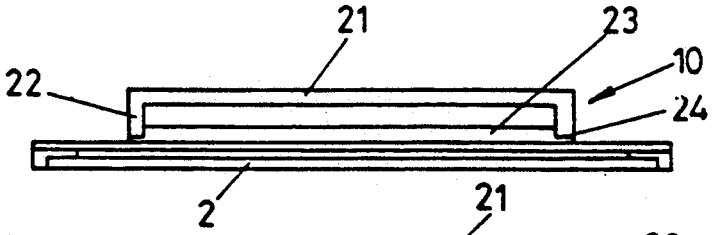
Figure 5B:
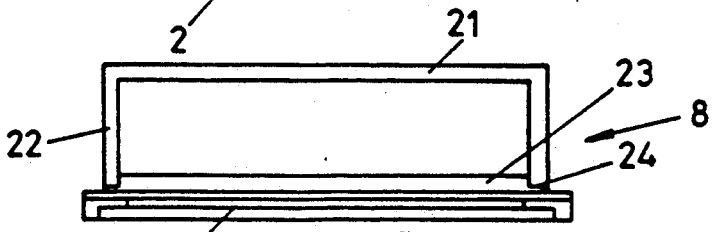
Figure 5C:
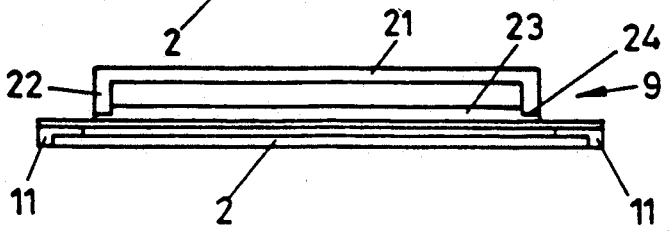

In the single-chamber shell construction shown in FIG. 5, the upper shell part 21 has the shape of a letter U with connectors 22 of different heights corresponding to the height of the hollow body. The lower shell part 23 is of even width and is provided with grooves or areas 24 which are formed offset for positive gluing of the two shell parts with each other.

Figure 6A:
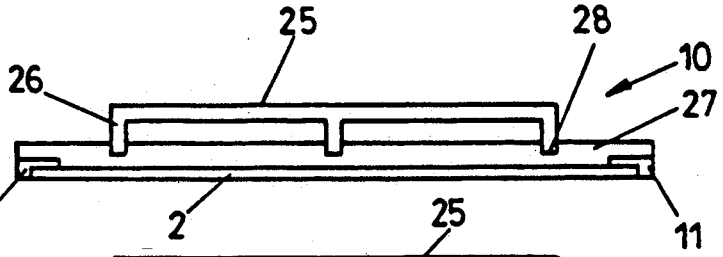
Figure 6B:
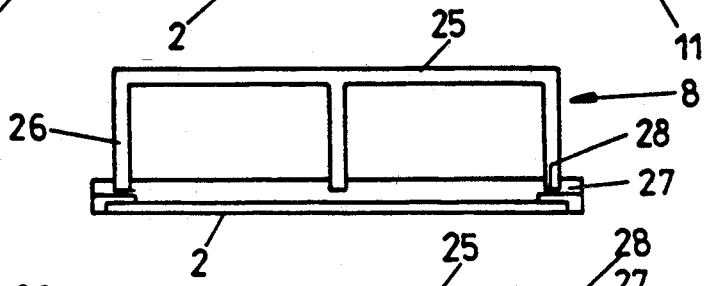
Figure 6C:
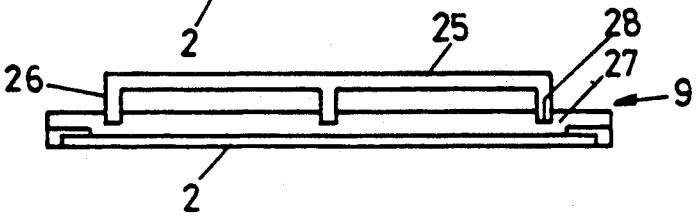

In the two-chamber shell construction shown in FIG. 6, the upper shell part 25 has the shape of the letter W with connectors 26 of different length, while the lower shell part 27 extends over the entire width of the ski and is provided with longitudinal grooves or longitudinal recesses 28 for positive gluing of the connectors 26.

Figure 7A:
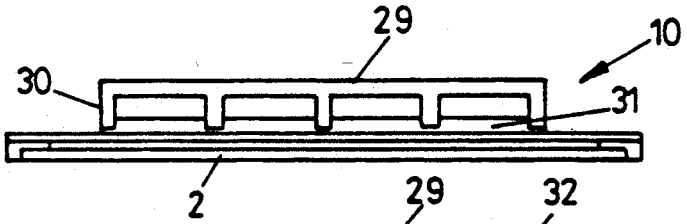
Figure 7B:
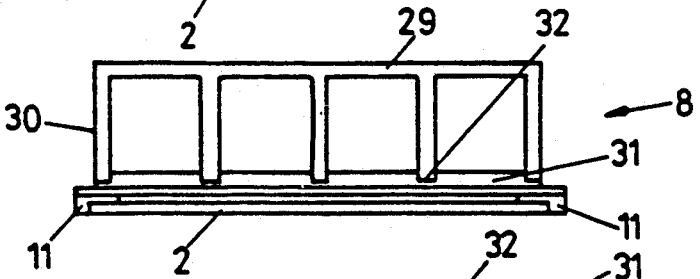
Figure 7C:
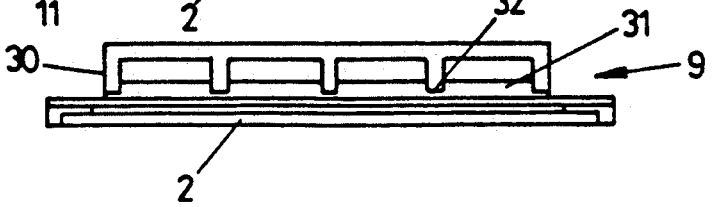
Figure 8A:
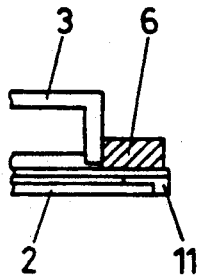
FIG. 8 shows various embodiments of the lateral surface components adjoining the hollow ski body.
Figure 8C:
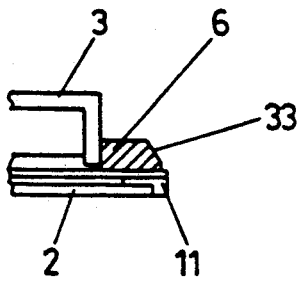
Figure 8B:
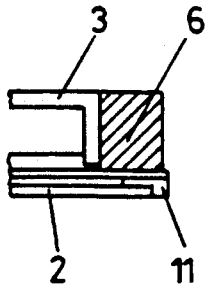
Figure 8D:
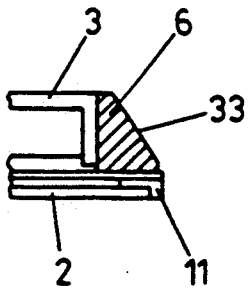

A shell construction similar to the one of FIG. 5 is shown in FIG. 7, where the upper shell part 29 has the shape of a quadruple letter U for a four-chamber shell construction with connectors 30 of different length disposed normally on the running surface 2, the lower shell part 31 again being of even width and being provided with grooves or longitudinal recesses 32 for positive gluing of the connectors 30 of the upper shell part with the lower shell part.

Different variants of lateral surface components 6 for the lateral covering of the running surface component 2 extending underneath the hollow ski body 3 formed with a constant width are shown in FIGS. 8*a* to 8*d*. The embodiments of the lateral surface components 6, shown in FIGS. 8*a* and *c*, have a constant height over the entire length of the ski, which is less than or maximally the same as the smallest height of the hollow ski body 3 having different heights, while the width is different, corresponding to the difference between the width of the running surface component 2 and the width of the hollow body 3. While the embodiment in accordance with FIG. 8*a* has a generally rectangular cross section, an area 33, slanting towards the outside, has been provided in the embodiment in accordance with FIG. 8*c*. In the embodiments in accordance with FIGS. 8*b* and *d*, the width of the lateral surface components 6 is, again as in the embodiments of FIGS. 8*a* and *c*, corresponding to the difference between the width of the running surface component 2 and the width of the hollow body 3, in this case the height of the lateral surface component 6 also being adapted to the height of the differing heights of the hollow body 3 in the longitudinal direction of the ski. Analogously to FIG. 8*a*, the lateral surface component 6 of FIG. 8*b* has a generally rectangular shape, while in the embodiment according to FIG. 8*d* again a slanted area 33 has been provided at the outer edge.

Figure 9:
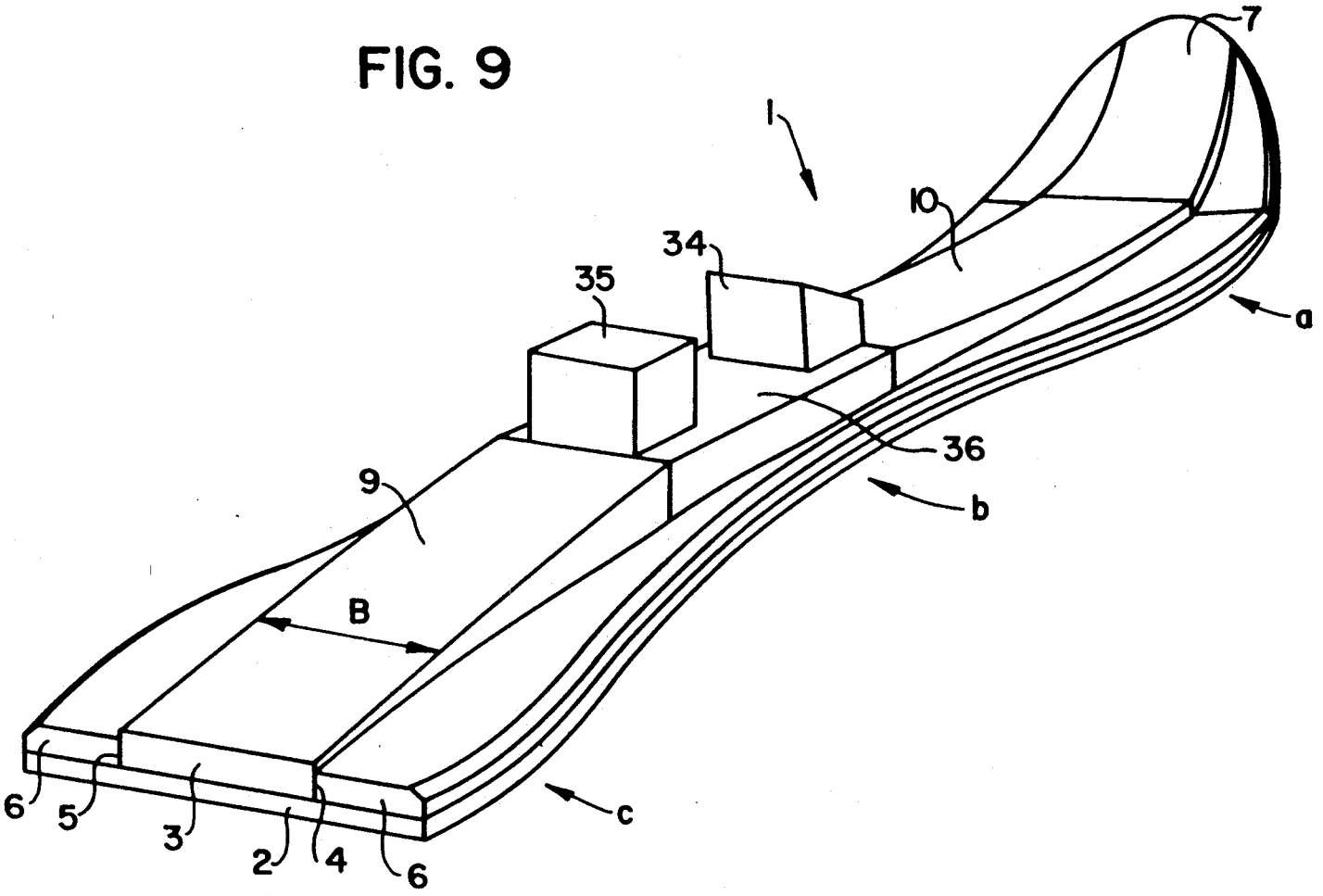
FIG. 9 depicts the ski with ski bindings mounted thereon.

FIG. 9 shows a preferred method of mounting ski boot bindings on a ski according to the present invention. In this Figure, front binding component 34 and rear binding component 35 are mounted on an even height central portion 36 of the ski body.

What is claimed is:

1. A ski having a length comprising:

an elongated, substantially hollow ski body, said body having a length equivalent to said ski length and a constant width over said body length, said body having a top, bottom and lateral sides defining a rectangular cross section; and a running surface secured directly to the bottom of the ski body along said body length, said running surface having a width varying over said body length, said running surface width, at a minimum, being no less than said body width, wherein said body top is adapted to receive ski binding parts.

2. A ski in accordance with claim 1, further comprising a cover secured to the top of said ski body.

3. A ski in accordance with claim 1 or 2, wherein:

said running surface comprises upper portions extending beyond said body width; and said ski further comprises lateral components secured to and projecting from said lateral sides of the ski body to cover said upper portions of said running surface.

4. A ski in accordance with claim 3, wherein an upper area of said lateral components is at an angle other than 90° to said upper portions of the running surface.

5. A ski in accordance with claim 1 or 2, wherein said ski body is divided into segments along said body length.

6. A ski in accordance with claim 1 or 2, wherein said ski body includes a central portion having a constant height adapted to receive ski binding parts.

7. A ski in accordance with claim 1 or 2, wherein the ski body includes a plurality of chambers disposed within said body and extending along said body length.

* * * * *